US006276818B1

(12) United States Patent
Wang

(10) Patent No.: US 6,276,818 B1
(45) Date of Patent: Aug. 21, 2001

(54) LATCH ASSEMBLY FOR LUMINAIRE HOUSING DOOR

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/500,526

(22) Filed: Feb. 9, 2000

(51) Int. Cl.[7] ..... F21V 21/00

(52) U.S. Cl. ..... 362/374; 362/375; 362/147; 292/5; 292/8

(58) Field of Search ..... 362/374, 375, 362/147; 292/5, 8

(56) References Cited

U.S. PATENT DOCUMENTS

| | | | |
|---|---|---|---|
| 2,899,542 | 8/1959 | De Mauro | 362/364 |
| 2,975,271 | 3/1961 | Dvorak | 3621/363 |
| 3,096,029 | 7/1963 | Berge | 362/254 |
| 3,185,835 | 5/1965 | Muller et al. | 362/324 |
| 3,281,588 | 10/1966 | Spinetta | 362/225 |
| 3,530,287 | 9/1970 | Husby | 362/226 |
| 3,654,453 | 4/1972 | Jablonski | 362/326 |
| 3,720,432 | 3/1973 | Chudler | 292/220 |
| 3,983,387 | 9/1976 | Van Steenhoven et al. | 362/375 |
| 4,220,986 | 9/1980 | Matteo et al. | 362/362 |
| 4,255,781 | 3/1981 | Plemmons et al. | 362/374 |
| 4,791,539 | 12/1988 | Ewing | 362/226 |
| 5,008,792 * | 4/1991 | Lietke et al. | 362/374 |
| 5,081,569 | 1/1992 | Quiogue et al. | 362/328 |
| 5,440,466 | 8/1995 | Belisle et al. | 362/222 |
| 5,727,871 | 3/1998 | Kotloff | 362/225 |
| 5,803,590 | 9/1988 | Wedell et al. | 362/226 |
| 5,927,843 | 7/1999 | Haugaard et al. | 362/147 |
| 5,997,158 | 12/1999 | Fischer et al. | 362/374 |
| 6,059,424 | 5/2000 | Kotloff | 362/220 |
| 6,149,280 | 11/2000 | Quiogue et al. | 362/147 |
| 6,168,300 | 1/2001 | Fischer et al. | 362/374 |
| 6,182,848 * | 2/2001 | Wang | 220/4.22 |

FOREIGN PATENT DOCUMENTS

| | | |
|---|---|---|
| 3841861 A1 | 7/1989 | (DE) . |
| 2646890 A1 | 11/1990 | (FR) . |
| 2704302 A1 | 10/1994 | (FR) . |

OTHER PUBLICATIONS

LSI Industries Inc. Scottsdale Superkit Catalog, p. 8; 1998.
Sketch of LSI Industries Inc. Scottsdale Superkit Latch.
Advertisement for LSI Industries Inc. Scottsdale Superkit.

* cited by examiner

*Primary Examiner*—Thomas M. Sember
*Assistant Examiner*—Ali Alari
(74) *Attorney, Agent, or Firm*—Mark S. Bicks; Tara L. Hoffman

(57) ABSTRACT

A luminaire housing has a frame with a securing member, a door panel releasably coupled to the frame and movable between open and closed positions. A latch assembly on the door panel releasably secures the door panel to the securing member of the frame. The latch assembly includes a fastening member received in a fastener slot of the door panel, a safety spring latch with a top camming portion, an intermediate body poron extending from the top camming portion, and a guide leg member extending from the intermediate body portion and attached to the door panel. A slide lock has a rail hole that slidably receives the guide leg member and has an aperture for receiving the fastener member. The slide lock is movable between a locked position engaged with the securing member to lock the door panel in the closed position and a release position disengaged and spaced from the securing member to allow the door panel to move toward the open position and to allow the safety spring latch to engage the securing member.

28 Claims, 4 Drawing Sheets

LATCH ASSEMBLY FOR LUMINAIRE HOUSING DOOR

FIELD OF THE INVENTION

The present invention generally relates to a lighting unit, such as a luminaires The lighting unit has a frame with a door panel pivotally coupled thereto and a latch assembly for locking and unlocking the door panel. The latch assembly includes a safety mechanism that includes a cooperating safety spring latch and slide lock. Upon locking the luminaire housing, the slide lock engages the frame and the door panel of the luminaire housing opens to a safety position.

BACKGROUND OF THE INVENTION

A luminaire is a lighting unit commonly installed on a ceiling. Usually luminaire housings are formed of a host housing unit and a pivotally attached door with a lighting assembly and electrical components mounted onto the door. A new door is retro-fit to conform to existing housing units. These lighting assemblies are normally heavy, weighing around 40 lbs, making installation and maintenance of the luminaire hazardous.

Prior art luminaire housings include a host housing with an interior flange and a door coupled thereto by a hinge. The door includes a mounting bracket which engages the housing flange to lock and unlock the door. The mounting bracket includes a sliding member and a spring. The spring serves to catch the housing flange upon the door opening. The sliding member uses two screws to move the sliding member in engagement with the housing flange, to lock the door, and to move the sliding member out of engagement with the housing flange.

The latch of the prior art luminaire housing requires the use of at least two screws with the mounting bracket thus requiring the use of two hands when moving the sliding member in and out of engagement with the housing flange. Other problems with the prior art latches involve the sliding member of the mounting bracket skewing or turning with respect to the spring when one screw is removed, and specifically the sliding member and spring of the mounting bracket completely disassembling forcing the user to re-assemble the bracket to close the door to the housing upon removal of the screws.

SUMMARY OF THE INVENTION

Accordingly, an object of the present invention is to provide a lurninaire housing that includes a latch that requires the use of only one screw permitting the use of only one hand and one step in locking and unlocking the door.

Another object of the present invention is to provide a luminaire housing that includes a latch with a slide lock and a safety spring that will not disassemble upon removal of the screw to prevent injury of an installer or repairer of the luminaire.

A further object of the present invention is to provide a luminaire housing having a latch with a slide lock and a safety latch where the slide lock cannot skew relative to the safety latch.

Yet another object of the present invention is to provide a luminaire housing with a door having a latch assembly that prevents injury from the door to a person installing or performing maintenance on the housing, particularly when installing a new door in an existing luminaire housing.

A yet further object of the present invention is to provide a luminaire housing assembly with a latch that remains locked even upon the inadvertent loosening of the screw.

The foregoing objects are basically attained by providing a luminaire housing including a frame having a securing member and a door panel releasably coupled thereto and movable between an open and closed position. The door panel has a fastener slot disposed therein. A latch assembly is disposed on the door panel for securing the door panel to the securing member of the frame. The latch assembly has a fastening member received in the fastener slot of the door panel for locking the door panel in said closed position, and a safety spring latch and slide lock. The safety spring latch has a top camming portion, an intermediate body portion extending therefrom and a guide leg member extending from the intermediate body portion and attached to the door panel. The slide lock has a rail hole slidably receiving the guide leg member of the safety spring latch and has an aperture for receiving the fastener member. The slide lock is movable between a locked position engaged with the securing member to lock the door panel in the closed position and a release position disengaged and spaced from the securing member to allow the door panel to move toward the open position and to allow the safety spring latch to engage the securing member.

By designing the latch assembly in this manner, it can be employed with various size door panels that can be retro-fit to accommodate existing host luminiare housings.

Other objects, advantages and salient features of the invention will become apparent from the following detailed description which taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
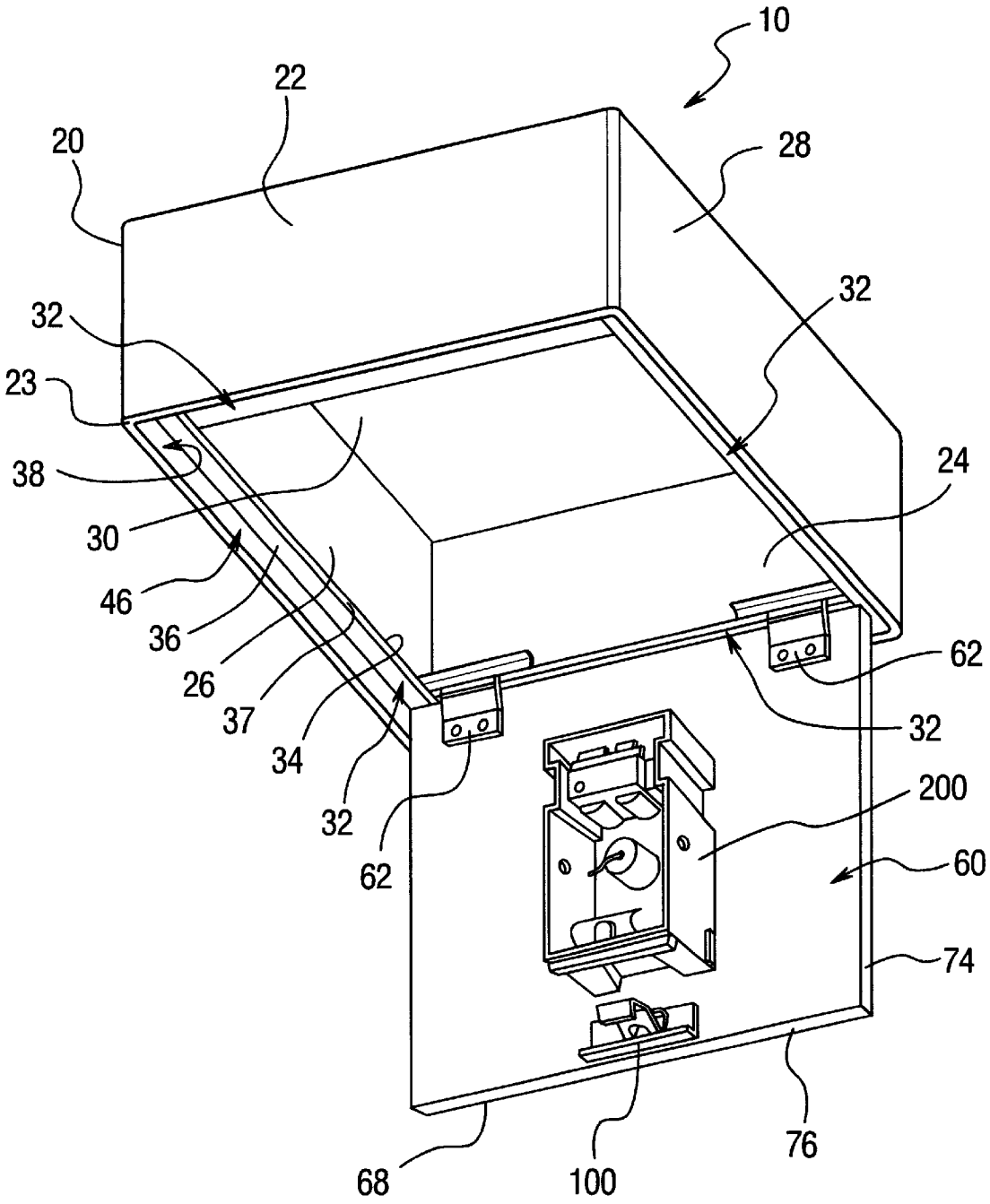
FIG. 1 is a bottom right side perspective view of a host luminaire housing with a lighting assembly according to an embodiment of the present invention, illustrating the retro-fit door panel coupled to an existing luminaire housing frame in its open position.
Figure 2:
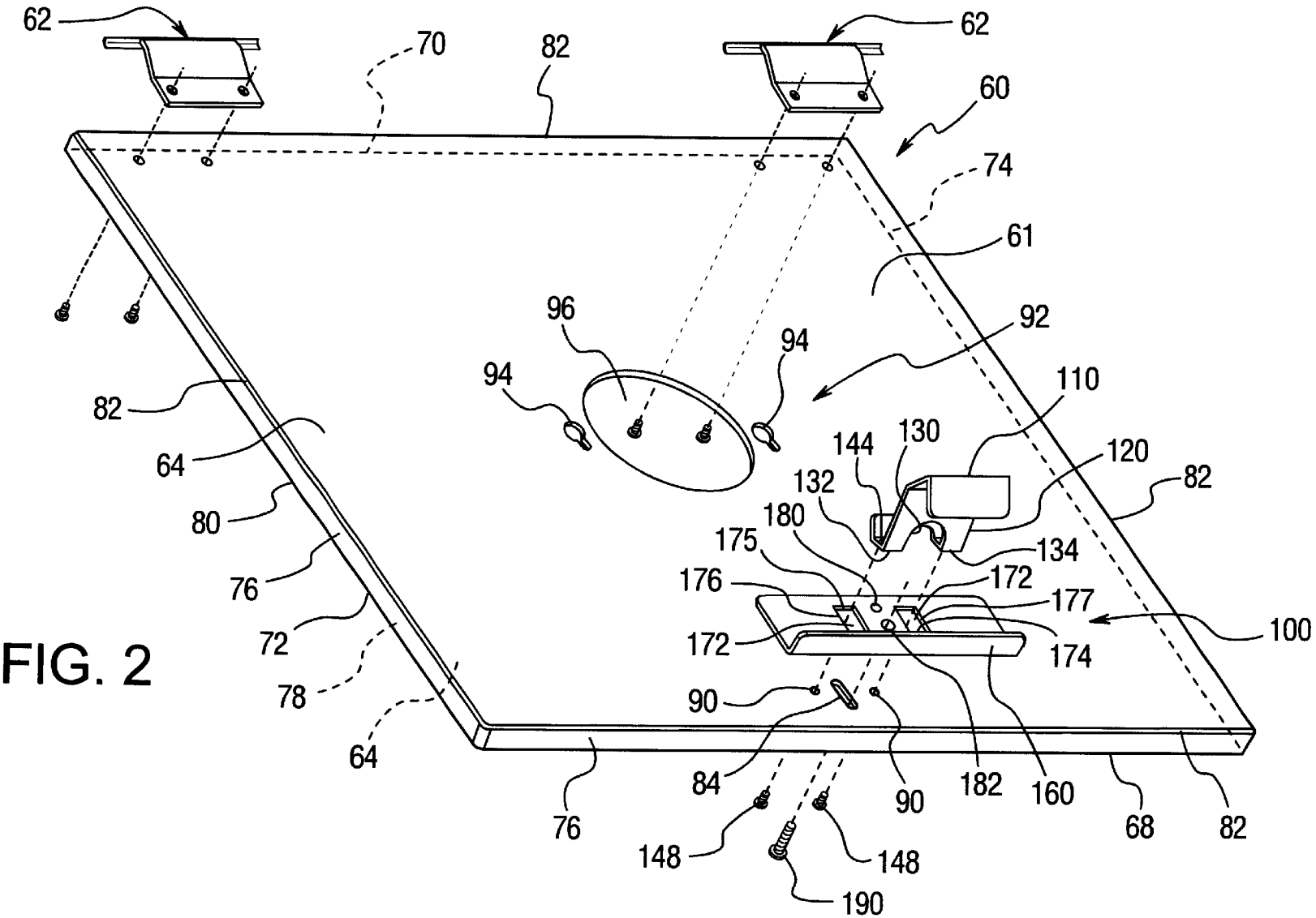
FIG. 2 is an exploded perspective view of the retro-fit door panel and latch assembly illustrated in FIG. 1.

Referring initially to FIGS. 1–2, a luminaire housing 10 in accordance with the present invention comprises a host housing unit frame 20, a retro-fit door panel 60 pivotally coupled to frame 20 by hinge 62, and latch assembly 100 attached to door panel 60 for locking and unlocking door panel 60 with frame 20. As seen in FIG. 1, a lighting assembly 200 is mounted to door panel 60 such that a portion of lighting assembly 200 extends through door panel 60. Preferably, frame 20, door panel 60, and latch assembly 100 all are formed of a metallic material. However, any type of rigid material, such as plastic, can be used to form these components.

Frame 20, as seen in FIG. 1, includes a front side wall 22, a rear side wall 24, a left side wall 26, a right side wall 28, and a top side wall 30. The front side wall 22 further includes a bottom edge 23. Front side wall 22 is connected to left side wall 26 at one end and right side wall 28 at the opposing end, and is disposed opposite rear side wall 24. Similarly, rear side wall 24 is connected to left side wall 26 at one end and right side wall 28 at the opposing end, and is disposed opposite front side wall 22. Left and right side walls 26 and 28 are disposed opposite one another. Front, rear, left and right side walls 22, 24, 26, and 28 are all substantially planar and extend from substantially planar top side wall 30 such that each of the planes of front, rear, left, and right side walls 22, 24, 26, and 28 are substantially perpendicular to the plane of top side wall 30. Each of front, rear, left, and right side walls 22, 24, 26, and 28 are of substantially equal length and depth forming a substantially square shaped frame with an open bottom.

Frame 20 can be of any of polygonal, circular or curved shape. Although side walls 22, 24, 26, 28, and 30 are preferably integrally connected, they can be separably connected by an attachment means such as an adhesive or the like.

Referring to FIGS. 1–7, a securing member or flange 32 has a top surface 34, a bottom surface 36, and an end 37, and is disposed on inner perimeter 38 of frame 20. Flange 32 extends inwardly from each of front, rear, left, and right side walls 22, 24, 26, and 28, and is spaced from top side wall 30 forming upper inner perimeter 40 and lower inner perimeter 42. Flange 32 and upper inner perimeter 40 create first receiving area 44 for accommodating a portion of light assembly 200 upon closing door panel 60 onto frame 20. Flange 32 and lower inner perimeter 42 create a second receiving area 46 for accommodating door panel 60 upon closing door panel 60 onto frame 20. First receiving area 44 is substantially larger than second receiving area 46. Preferably, flange 32 is integrally connected to frame 20, although it can be separably formed and connected by adhesive or the like. Flange 32 has a thickness that is substantially the same as the thickness of frame 20.

Door panel 60 includes a substantially planar body 61 with a detachable hinge 62 disposed thereon for separating and pivotally coupling door panel 60 to frame 20. Hinge 62 is fully disclosed in concurrently filed U.S. patent application Ser. No. 09/500,531 of James Wang entitled Luminaire Housing With Universal Dual Surface Cantilever Hinge, the subject matter of which is hereby incorporated by reference.

Planar body 61 has an upper surface 64 and a lower surface 66. A front shoulder 68, rear shoulder 70, left shoulder 72, and right shoulder 74 extend downwardly from lower surface 64 such that the plane of planar body 61 is substantially perpendicular to the plane of each shoulder 68, 70, 72, and 74. Each shoulder has a front planar surface 76, an opposing back planar surface 78, and a bottom surface 80 with all being substantially equal in length and thickness. Shoulders 68, 70, 72 and 74 form an outer edge 82 of door panel 60. Preferably, shoulders 68, 70, 72, and 74 are integrally connected to planar body 61, but may be separably formed and connected such as by adhesive means or the like. Planar body 61 is preferably square in shape, however, it can be of any polygonal or circular shape that can be accommodated by second receiving area 46 of frame 20.

A fastener slot 84 extends through planar body 61 of door panel 60 proximate front shoulder 68 and outer edge 82 for receiving fastening member 190. Preferably, the fastener slot is substantially elongated and oval in shape, with a front edge 86 and rear edge 88. Such fastener slot can also be of any elongated shape that will accommodate fastening member 190, which is preferably a standard screw. Rivet holes 90 also extend through the door panel body and are located on opposite sides of fastener slot 84.

Lighting assembly 200 is removably mounted to upper surface 64 of door panel 60 by mounting 92, as seen in FIGS. 1 and 2. Assembly mounting 92 is preferably centrally located on planar body 61 and includes key holes 94 and a mounting aperture 96. However, mounting 92 can also be disposed off-center. Key holes 94 are substantially smaller than mounting aperture 96. Mounting bolts (not shown) of lighting assembly 200 extend through key holes 94. A portion of lighting assembly 200 is received in mounting aperture 96. Although at least two key holes 94 are preferred, only one key hole 94 is required to mount light assembly 200.

Latch assembly 100 locks and unlocks door panel 60 with respect to frame 20. The latch assembly is disposed on door panel 60 such that it covers and corresponds with fastener slot 84. As seen in FIGS. 2–7, latch assembly 100 includes a safety spring latch 110, a slide lock 160, and a fastening member 190.

Figure 3:
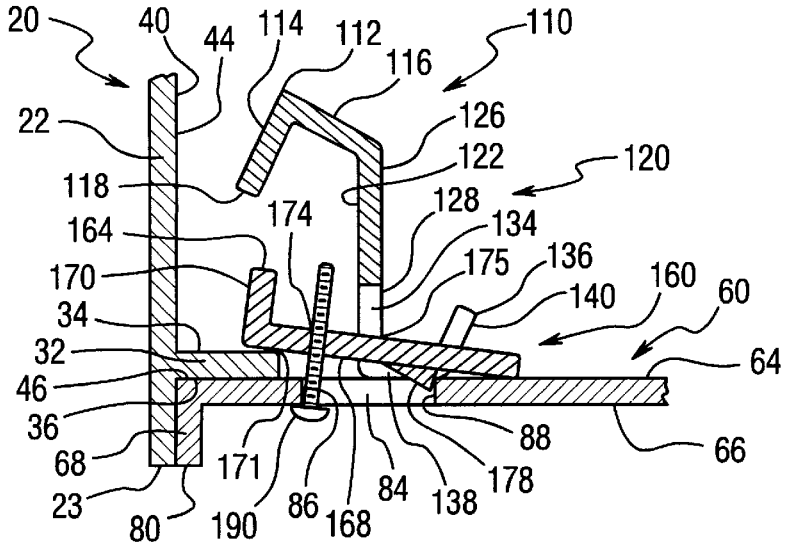
FIG. 3 is an enlarged, partial side elevational view in section of the luminaire housing of FIG. 1 illustrating the latch assembly in the locked position.

Safety spring latch 110 includes a top camming portion 112, an intermediate body portion 120, and a guide leg members 136. Top camming portion 112 includes a first portion 114 and a second portion 116 (FIG. 3). First and second portions 114 and 116 are substantially planar with their widths being substantially equal. First portion 114 is slightly longer than second portion 116 and first portion 114 extends at an acute angle from second portion 116. The first and second portions can also be identical in their dimensions.

Intermediate body portion 120 has a front surface 122 and a back surface 124, and an upper portion 126 and lower portion 128. Upper portion 126 extends downwardly from second portion 116 of top camming portion 112. Extending the entire height of a lower portion 128 is U-shaped cut-out 130. U-shaped cut-out 130 forms opposing first and second half sections 132 and 134. Both upper and lower portions 126 and 128 are substantially planar; and opposing half sections 132 and 134 are substantially identical.

Guide leg members 136 extend from each half section 132 and 134 and are adapted to guide slide lock 160 discussed in detail below. Each guide leg member includes a first planar part 138 and a second planar part 140. First part 138 extends from back surface 124 and lower portion 128 of intermediate body portion 120 such that the plane of first part 138 is substantially perpendicular to the plane of intermediate body portion 120. However, intermediate body portion 120 can also be angled backward with respect to first part 138. First part 138 includes a bottom surface 142 and a rivet hole 144. Second part 140 extends at an obtuse angle from first part 138 and has a rear surface 146.

Rivets 148 extend through rivet holes 90 in door panel 60 and rivet hole 144 in each guide leg member 136 to fix safety spring latch 110 to door panel 60 such that fastener slot 84 is located between guide leg members 136. Other means of attachment could be employed, such as pins, screws, or adhesive. Although it is preferred that two guide members 136 be used, only one guide member 136 could be used for attaching the safety spring latch 110.

Preferably, the components of the safety spring latch 110, top camming portion 112, intermediate body portion 120 and guide leg members 136, are uritarily connected and have substantially the same width. These components, however, can be formed separably and connected by an attachment means such as adhesive or the like. In addition the widths of the components with respect to each other can vary without affecting the utility of safety spring latch 110.

Slide lock 160 slidably receives safety spring latch 110 such that slide lock 160 can move longitudinally and laterally relative to safety spring latch 110. Slide lock 160 includes a main plate member 162 and an upstanding member 164 extending perpendicularly from the main plate member such that the side cross-section of slide lock 160 is substantially L-shaped, as shown in FIGS. 3–7. The length of main plate member 162 is substantially greater than the height of upstanding member 164. Main plate member 162 has an upper surface 166 and a lower surface 168. Upstanding member 164 has a front surface 168 and a back surface 169. While preferred, upstanding member 164 is not required for the operation of slide 160 discussed below.

Substantially rectangular rail holes 172 are centrally disposed on main plate member 162 and are proximately disposed to one another. Each rail hole has a front portion 174, a rear portion 175, a left portion 176, and a right portion 177. These rail holes 172 are adapted to slidably receive guide leg members 136 of safety spring latch 110 such that each guide leg member is bounded by front, rear, left and right portions 174, 175, 176, 177 of the respective rail hole 172. Upon sliding slide lock 160 between a locked position (FIG. 3) and a released position (FIG. 5), discussed in detail below, guide leg members 136 guide slide lock 160, preventing main plate member 162 from skewing and ensuring that the edge of main plate member 162 remains parallel to outer edge 82 of door panel 60. Rail holes 172 can be of any shape that can accommodate guide leg members 136.

A positive locking tab 178 extends downwardly from lower surface 168 for engaging fastener slot 84 of door panel 60. Positive locking tab 178 is disposed between rail holes 172 proximate each rear portion 176. Preferably, positive locking tab 178 is triangular in cross-section and is formed by a depression 180 in main body portion 162. However, positive locking tab 178 can be of any polygonal shape, such as rectangular, that is sufficient to engage fastener slot 84. Also, positive locking tab 178 can be formed of a projection depending from lower surface 168 rather than by depression 180.

Figure 5:
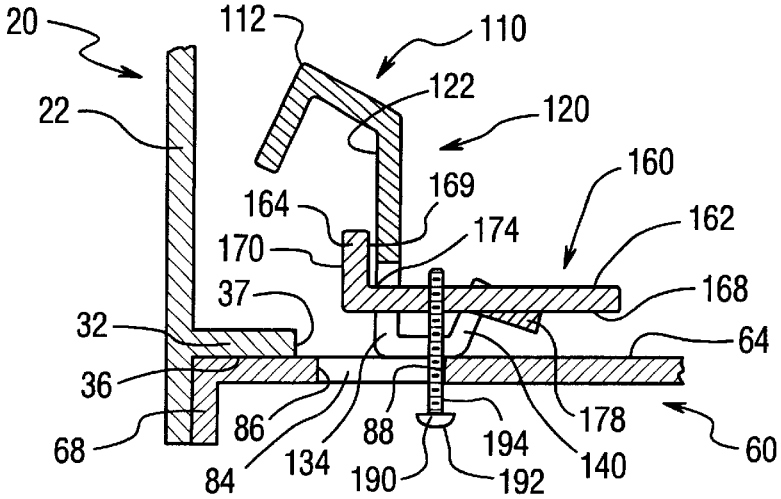
FIG. 5 is an enlarged, partial side elevational view in section of the luminaire housing of FIG. 1 illustrating the latch assembly in the second step of being unlocked.

Fastener aperture 182 is aligned with positive locking tab 178 between rail holes 172 proximate each front portion 174. The fastener aperture 182 corresponds with fastener slot 84 of door panel 60 and receives fastening member 190 for locking and unlocking latch assembly 100. Fastening member 190 includes bottom end 192 and gripping portion 194 for gripping and slidably moving slide 160 (FIG. 5).

As seen in FIGS. 3–7, in operation safety spring latch 110, slide lock 160, and fastening member 190 cooperate to control movement of door panel 60 between a closed position and an open position.

FIG. 3 depicts the latch assembly in a locked position locking door panel 60 in the closed position where door panel 60 is received in second receiving area 46 and upper surface 64 of door panel 60 abuts bottom surface 36 of flange 32. In the locked position, the slide lock 160 engages flange 32 by its lower surface 168 abutting top surface 34 of flange 32. Specifically, portion 171 of slide lock 160, defined between front surface 170 of upstanding member 164 and each front portion 174 the rail holes, rests on top surface 34 of flange 32. Fastening member 190 is fully extended and tightened through both fastener slot 84 of door panel 60 and fastener the aperture of slide lock 160 such that bottom end 192 of fastening member 190 abuts lower surface 66 of door panel 60 securing door panel 60 in the closed position. Additionally, fastening member 190 also abuts front edge 86 of fastener slot 84 to locate the slide lock in the proper position on the frame flange. Positive locking tab 178 abuts rear edge 88 of fastener slot 84 to ensure that slide lock 160 will not disengage from flange 32 even if fastening member 190 inadvertently becomes loose. Safety spring latch 110 is disengaged from flange 32 such that distal end 118 of top camming portion 112 is spaced above top surface 34 of flange 32. Rear portion 175 of each rail hole of slide lock 160 abuts rear surface 146 of each guide leg member 136 of safety spring latch 110.

Figure 4:
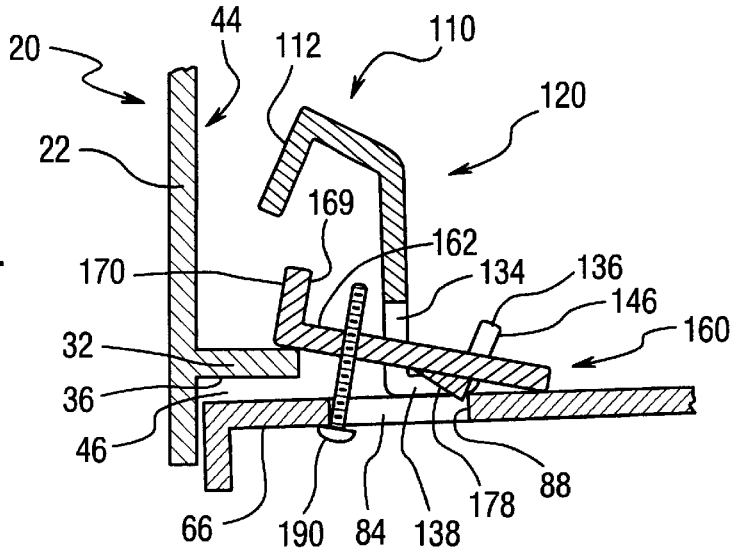
FIG. 4 is an enlarged, partial side elevational view in section of the luminaire housing of FIG. 1 illustrating the latch assembly in the first step of being unlocked.

FIG. 4 shows the first step in releasing latch assembly 100 and unlocking door panel 60. Fastening member 190 is loosened or partially unthreaded. As a result door panel 60 drops down slightly spacing upper surface 64 of door panel 60 from bottom surface 36 of flange 32. Slide lock 160 remains engaged with flange 32 and positive locking tab 178 remains engaged with rear edge 88 of fastener slot 84. Safety spring latch 110 also drops down slightly and concurrently guide leg members 136 slide through the rail holes of slide lock 160.

FIG. 5 depicts the second step in releasing latch assembly 100 and unlocking door panel 60. Gripping portion 194 of fastening member 190 is gripped using either fingers or a tool such as a screw driver, pliers or the like. Using gripping portion 194, fastening member 190 is pushed upwardly and slid laterally until fastening member 190 abuts rear edge 88 of fastener slot 84 disengaging slide lock 160 from flange 32 and disengaging positive lock tab 178 from fastener slot 84. Consequently, lower surface 168 of slide lock 160 is spaced above and away from top surface 34 of flange 32, and positive lock tab 178 is cleared of fastener slot 84. Door panel 60 is simultaneously pushed upwardly such that upper surface 64 of door panel 60 abuts bottom surface 36 of flange 32. Safety spring latch 110 remains spaced above flange 32. Front surface 122 at the first and second half sections of intermediate body portion 120 abut each front portion 174 of the rail holes of slide lock 160. Back surface 169 of upstanding member 164 of slide lock 160 is slightly spaced from front surface 122 of intermediate body portion 120 of safety spring latch 110.

Figure 6:
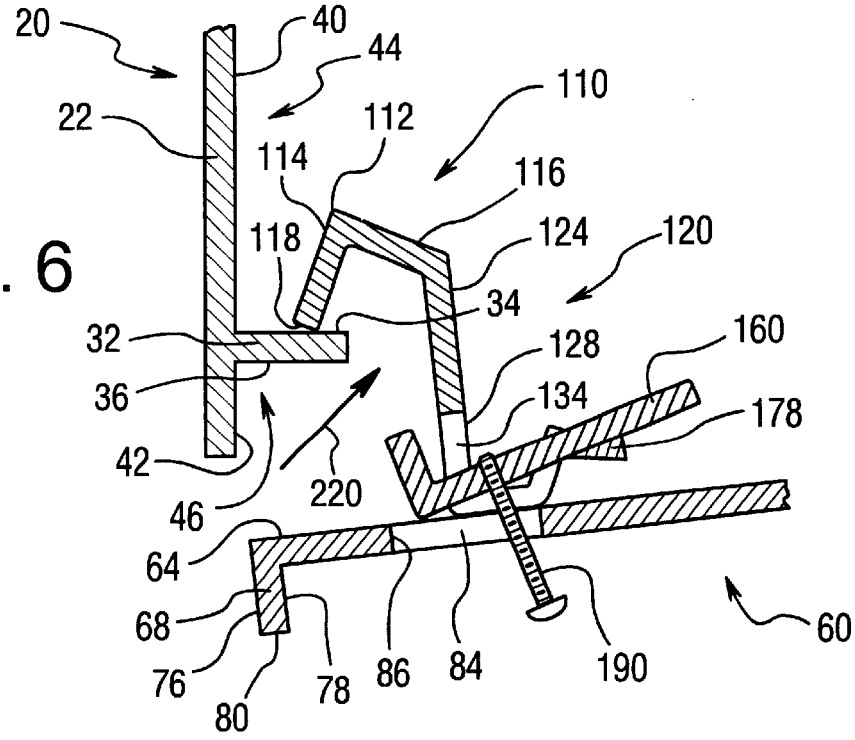
FIG. 6 is an enlarged, partial side elevational view in section of the luminaire housing of FIG. 1 illustrating the latch assembly unlocked in the release position.

FIG. 6 depicts the latch assembly in the released position with door panel 60 being in a partially open position. As a result of disengagement of slide lock 160, door panel 60 is free to drop down. Lighting assembly 200 mounted on door panel 60 adds substantial weight to door panel 60. Safety spring latch 110 provides a safety mechanism by preventing door panel 60 from dropping unabated to its fully open position upon releasing latch assembly 100. Specifically, distal end 118 of safety spring latch 110 engages surface 34 of flange 32 such that door panel 60 is suspended. Thus, the person attempting to open door panel 60 will be protected from injury as a result of door panel 60 falling. Slide lock 160 slides downwardly on safety spring latch 110 and rests on upper surface 64 of door panel 60 with fastening member 190 extending through fastener slot 84.

Figure 7:
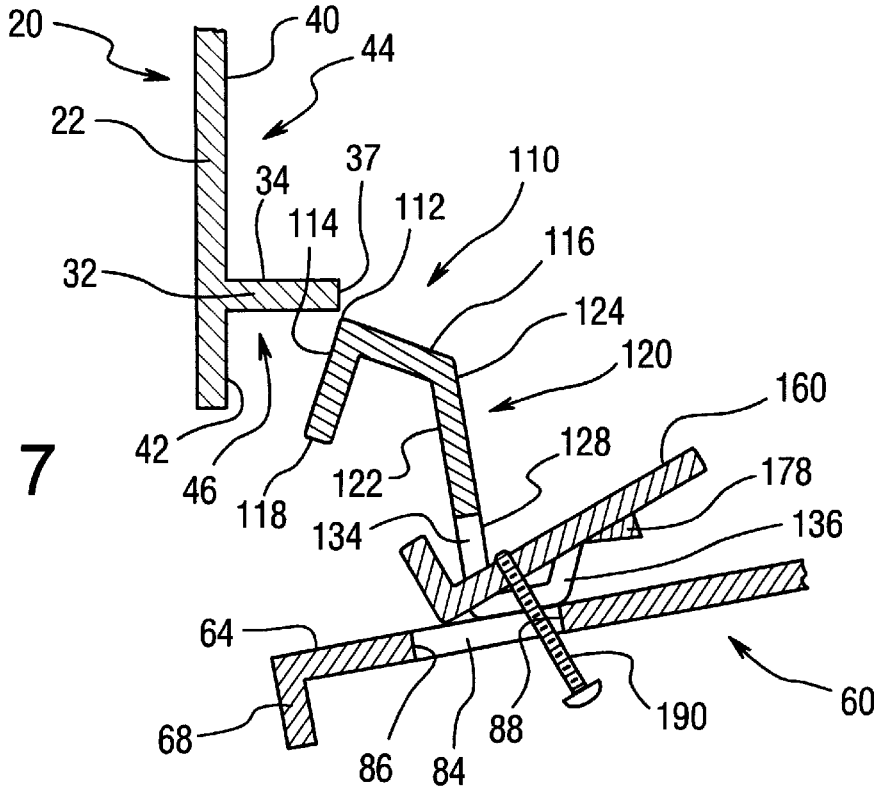
FIG. 7 enlarged, partial side elevational view in section of the luminaire housing of FIG. 1 illustrating the latch assembly being disengaged from the luminaire.

FIG. 7 shows the latch assembly disengaged from flange 32 such that door panel 60 can swing completely open allowing access to the lighting assembly. Specifically, as shown by arrow 220 in FIG. 6, pressure is applied to intermediate body portion 120 of safety spring latch 110 such that top camming portion 112 is pushed backward clearing distal end 118 from flange 32. To reengage safety spring latch 110 with flange 32, door panel 60 is simply pushed upward such that first portion 114 of top camming portion 112 contacts flange 32, camming first portion 114 backward, clearing top camming portion 112 of flange 32 and allowing distal end 118 to re-engage flange 32 as illustrated in FIG. 6. To then lock the latch assembly and close door panel 60, door panel 60 is then pushed upwardly and fastening member 190 and slide lock 160 are slid laterally such that the slide lock re-engages the flange, fastening member 190 abuts front edge 86 of fastener slot 84, and positive locking tab 178 engages rear edge 88 as illustrated in FIG. 4. Fastening member 190 is then tightened to secure door panel 60 in the closed position as seen in FIG. 3.

Upon removal of fastening member 190, latch assembly 100 will remain assembled because each guide leg member 136 of safety spring latch 110 is coupled to each rail hole of slide lock 160. In addition, the use of only one fastening member 190 is required reducing the number of hands and steps needed for locking and unlocking latch assembly 100.

While a particular embodiment has been chosen to illustrate the invention, it will be understood by those skilled in the art that various changes and modifications can be made therein without departing from the scope of the invention as defined in the appended claims.

What is claimed is:

1. A luminaire housing, comprising:

a frame having a securing member;

a door panel releasably coupled to said frame and movable between open and closed positions, said door panel having a fastener slot therein; and a latch assembly on said door panel for releasably securing said door panel to said securing member of said frame, said latch assembly including, a fastening member received in said fastener slot of said door panel, a safety spring latch having a top camming portion, an intermediate body portion extending from said top camming portion, and at least one guide leg member extending from said intermediate body portion and being attached to said door panel, and a slide lock having a rail hole for slidably receiving said guide leg member of said safety spring latch and having an aperture for receiving said fastener member, said slide lock being movable between a locked position engaged with said securing member to lock said door panel in said closed position and a release position disengaged and spaced from said securing member to allow said door panel to move toward said open position and to allow said safety spring latch to engage said securing member.

2. A luminaire housing according to claim 1, wherein said rail hole has a front portion, a rear portion, a left portion, and a right portion; and said guide leg member is bounded by said front, rear, left, and right portions.

3. A luminaire housing according to claim 1, wherein said slide lock and said safety spring are coupled independently of said fastening member.

4. A luminaire housing according to claim 1, wherein said guide leg member prevents said slide lock from skewing relative to said safety spring latch.

5. A luminaire housing according to claim 1, wherein said securing member is a flange with top and bottom surfaces.

6. A luminaire housing according to claim 5, wherein said frame has an inner perimeter, said flange extending from said inner perimeter.

7. A luminaire housing according to claim 5, wherein said slide lock has a lower surface abutting said top surface of said flange when said slide lock is in said locked position; and said guide leg member of said safety spring latch abuts a rear portion of said rail hole.

8. A luminaire housing according to claim 7, wherein said top camming portion of said safety spring latch is spaced from said top surface of said flange.

9. A luminaire housing according to claim 7, wherein in said locked position said aperture in said slide lock is substantially aligned with said fastener slot in said door panel, and said fastening member abuts a front edge of said fastener slot.

10. A luminaire housing according to claim 9, wherein said door panel has an outer edge, said fastener slot being located proximate to said outer edge.

11. A luminaire housing according to claim 7, wherein said slide lock includes a positive locking tab extending from said lower surface, said positive locking tab releasably engaging a rear edge of said fastener slot.

12. A luminaire housing according to claim 5, wherein said slide lock has a lower surface spaced from said top surface of said flange when said slide lock is in said release position allowing said door panel to move toward said open position, and said guide leg member of said safety spring latch abuts a front portion of said rail hole.

13. A luminaire housing according to claim 12, wherein said top camming portion overlies and is spaced above said top surface of said flange in said locked position and abuts said top surface of said flange in said release position.

14. A luminaire housing according to claim 12, wherein said fastening member abuts a rear edge of said fastener slot in said release position.

15. A luminaire housing according to claim 14, wherein said door panel has an outer edge, said fastener slot being located proximate to said outer edge.

16. A luminaire housing according to claim 12, wherein said slide lock has a positive locking tab extending from said lower surface, said locking tab being disengaged and spaced from said fastener slot in said release position.

17. A luminaire housing according to claim 1, wherein said top camming portion having a first planar portion and a second planar portion, said first planar portion extending at an acute angle from said second planar portion.

18. A luminaire housing according to claim 17, wherein said intermediate portion has an upper planar portion and a lower planar portion, said upper planar portion extending from said second planar portion of said top camming portion.

19. A luminaire housing according to claim 18, wherein said lower planar portion includes a U-shaped cut-out forming opposite first and second half portions.

20. A luminaire housing according to claim 19, wherein said guide leg member extends from one of said first and second half portions.

21. A luminaire housing according to claim 1, wherein said guide leg member has a first planar part and a second planar part, said first planar part extending substantially perpendicularly from said intermediate body portion and said second planar part extending at an obtuse angle from said first planar part.

22. A luminaire housing according to claim 21, wherein said first planar part of said guide leg member is attached to said door panel.

23. A luminaire housing according to claim 1, wherein said safety spring latch assembly includes a plurality of guide leg members.

24. A luminaire housing according to claim 23, wherein said slide lock has plurality of rail holes for slidably receiving each of said plurality of guide leg members.

25. A luminaire housing according to claim 1, wherein said fastener member is a screw.

26. A luminaire housing according to claim 1, wherein said door panel includes a lighting assembly mounting.

27. A luminaire housing according to claim 26, wherein said mounting includes a mounting aperture and a plurality of key holes, said mounting aperture having a diameter substantially larger than a diameter of each of said plurality of key holes.

28. A luminaire housing, comprising:

a frame having an inner perimeter and a flange with top and bottom surfaces extending from said inner perimeter;

a door panel releasably coupled to said flange of said frame and movable between closed position and open positions, said door panel having an upper surface, an outer edge and a fastener slot with a front edge and rear edge located proximate to said outer edge; and a latch assembly on said door panel including, a safety spring latch attached to said door panel including, a top camming portion having first and second planar portions, said first planar portion extending at an acute angle from said second planar, an intermediate body portion extending from said second planar portion of said top camming portion, said intermediate body portion having upper and lower planar portions, said lower planar portion including a U-shaped cut-out, said U-shaped cut-out forming opposite first and second half sections in said lower planar portion, and a first guide leg member extending from said first half section and a second guide leg member extending said second half section, each said guide leg member having first and second planar parts, each said first planar part being attached to said upper surface of said door panel and being substantially perpendicular to said intermediate body portion, said second planar part extending at an obtuse angle from said first planar part, a slide lock having a lower surface and first and second rail holes located in a mid-section of said slide lock, each of said first and second rail holes having a front portion and a rear portion, said first and second guide leg members being slidably received in said first and second rail holes, respectively, a fastener aperture between said first and second rail holes, said fastener aperture corresponding to said fastener slot of said door panel, a positive locking tab extending from said lower surface, and a fastening member slidably received in said fastener slot of said door panel and said fastener aperture of said slide lock.

* * * * *